United States Patent [19]

Presant

[11] Patent Number: 5,037,001

[45] Date of Patent: Aug. 6, 1991

[54] MEANS AND METHOD FOR METERED SINGLE-DROP DISPENSING OF WATER SOLUTIONS FROM AEROSOL CONTAINER

[76] Inventor: Fred Presant, 723 Kyle La., West Haven, Conn. 06515

[21] Appl. No.: 634,974

[22] Filed: Jan. 7, 1991

Related U.S. Application Data

[63] Continuation of Ser. No. 370,810, Jun. 23, 1989, abandoned.

[51] Int. Cl.[5] ..... B65D 47/18

[52] U.S. Cl. ..... 222/1; 222/402.1; 222/422

[58] Field of Search ..... 222/422, 420, 402.1, 222/402.13, 402.24, 402.25, 1

[56] References Cited

U.S. PATENT DOCUMENTS

| | | | |
|---|---|---|---|
| 2,539,929 | 1/1951 | Roberts . | |
| 2,562,111 | 7/1951 | Michel | 222/394 |
| 2,631,814 | 3/1953 | Abplanalp . | |
| 2,715,481 | 8/1955 | McGhie et al. . | |
| 2,723,200 | 11/1955 | Pyenson . | |
| 2,742,195 | 4/1956 | Elder, Jr. . | |
| 2,748,985 | 6/1956 | Seymour . | |
| 2,856,235 | 10/1958 | Ward . | |
| 2,932,434 | 4/1960 | Abplanalp | 222/394 |
| 3,170,462 | 2/1965 | Hall . | |
| 3,677,447 | 7/1972 | Rentz | 222/420 |
| 3,934,585 | 1/1976 | Maurice | 222/420 |
| 4,019,657 | 4/1977 | Spitzer | 222/635 |
| 4,439,343 | 3/1984 | Albanese . | |
| 4,585,577 | 4/1986 | Bartlett et al. | 252/305 |
| 4,655,959 | 4/1987 | Stopper | 222/635 |

*Primary Examiner*—David H. Bollinger

*Attorney, Agent, or Firm*—Ware, Fressola, Van Der Sluys & Adolphson

[57] ABSTRACT

Delivery of water solutions in metered drops through a metered valve aerosol package by specific selection of propellant and valve actuator allows multidose dispensing of preservative-free product formulations to a selected site of application. A known type of metering valve is used with a water-soluble propellant, which permits dispensing of a single drop of product in the form of a clear drop or an unstable, readily breakable foam. The propellant rapidly evaporates from the drop, while any foam collapses, leaving a clear liquid drop. A preferred propellant is dimethyl ether.

14 Claims, 1 Drawing Sheet

MEANS AND METHOD FOR METERED SINGLE-DROP DISPENSING OF WATER SOLUTIONS FROM AEROSOL CONTAINER

This is a continuation of copending application(s) Ser. No. 07/370,810 filed on June 23, 1989, now abandoned.

BACKGROUND OF THE INVENTION

1. Field of the invention

The present invention relates to the dispensing of medicaments and like substances in single drop form generally and, more particularly, to a novel method and means for dispensing such substances from aerosol containers in metered single drops.

2. Background Art

There are many applications in which it is desirable to dispense accurately metered doses of medicaments and like substances, such as ophthalmic medicaments. Most solutions available for single drop usage are aqueous base solutions which are dispensed from squeeze-base dropper packages. A substantial limitation of such packages is control of the number and size of drops dispensed from the dropper and the maintenance of sterility of the contents of the packages. The former problem arises from the fact that the dropper must be squeezed with pressure within a relatively narrow range of magnitude in order to achieve a single drop. The latter problem arises from the fact that there is no positive sealing of the outlet of the package, as, typically, the contents are exposed while the dropper is removed from the package, the dropper is exposed during use, and air is drawn into the package to replace solution removed. In some cases, remedying the latter problem requires the addition of preservatives to the ingredients.

Aerosol packages have been employed for the dispensing of medicaments in spray form for topical use. Additionally, such aerosol packages have been employed for the dispensing of such substances as perfumes, mouth fresheners, and make-up materials. They have also been widely used for dispensing inhalation drugs where medicaments in suspension or solution are propelled with large quantities of propellant to keep the particle sizes small in order to effectively enter the lungs of the user. The latter, for example, advantageously uses the mucous membrane in the nose, buccal cavity, and the lungs as a vehicle to introduce drugs into the blood stream. For some products, such as make-up foam mousse, a stable foam is desirable and to obtain the same, water-insoluble propellants such as isobutane or propane are used with the water-based ingredients to yield a stable foam.

Aerosol packages offer the advantages of positive closure of the package after use and no air is drawn into the package to replace the ingredients dispensed; therefore, in many cases, there is no need for the addition of preservatives to the ingredients. An additional advantage of aerosol packages is that they are highly tamperproof.

Many aerosol packages continue to deliver product as long as the aerosol valve is actuated; however, devices for the delivery of metered aerosol sprays are well known and are available, for example, from Valois, Le Prieure BP G-27110 Le Neubourg, France, which furnishes metering valves to provide a measured quantity of the material being dispensed in a spray form wherein the metering valve restricts the amount of material emitted from the aerosol package. These valves are used predominantly for inhalation drugs. Such devices typically employ propellants which are highly water-insoluble and, as noted above, are provided in a high proportion relative to the effective material being dispensed. A substantial limitation of such delivery systems is that the high velocity of the spray, resulting from the high ratio of propellant, may be irritating and a medicament or similar substance in spray form is difficult to direct to the desired point of use. It is even more difficult to assure that the entire quantity of substance is delivered to that desired point of application. Another limitation of such systems is that they are unsuitable for the delivery of ophthalmic preparations because of the potential irritation of the eye by the nature of the propellants used and by the substantial chilling effect caused by the expansion of the large quantity of propellants used.

It is desirable that there be provided an aerosol-type delivery system which has the advantages of maintenance of sterility of substances, yet avoids the disadvantages thereof. As noted above, presently known metered aerosol delivery systems provide the applied substance in spray form.

Accordingly, it is a principal object of the present invention to provide a method and means for metered single-drop aerosol dispensing which permit delivery of a selected quantity of a substance to a selected site in essentially drop form.

Another object of the invention is to provide such method and means that permit the delivery of such substances while maintaining sterility thereof.

Other objects of the invention, as well as particular advantages and features thereof, will be elucidated in, or apparent from, the following description and the accompanying drawing figures.

SUMMARY OF THE INVENTION

Delivery of water solutions in metered drops through a metered valve aerosol package by specific selection of propellant and valve actuator allows multidose dispensing of preservative-free product formulations to a selected site of application. A known type of metering valve is used with a water soluble propellant which permits dispensing of a single drop of product in the form of a clear drop or an unstable, readily breakable foam. The propellent rapidly evaporates from the drop, while any foam collapses, leaving a clear liquid drop. A preferred propellant is dimethyl ether.

DETAILED DESCRIPTION OF THE PREFERRED EMBODIMENTS

Figure 1:
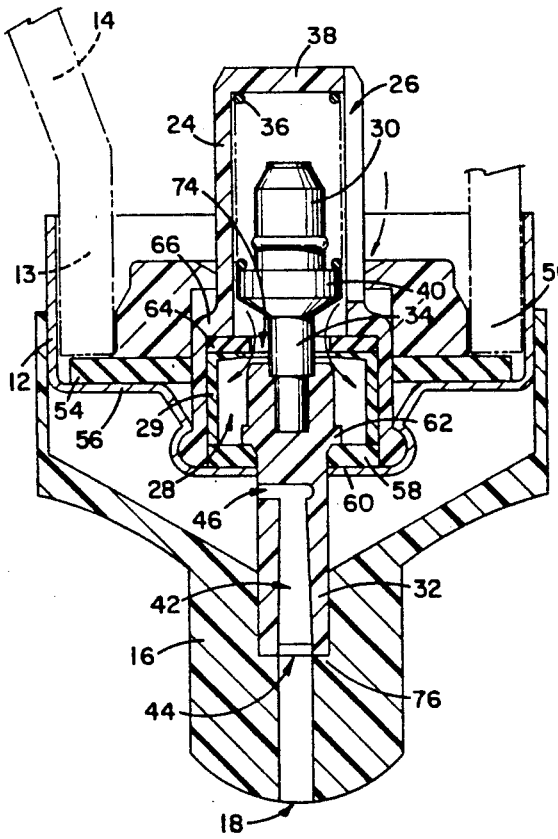
FIG. 1 is an enlarged cross-sectional side elevation view of a single-dose metering valve in closed position.

Referring now to the drawings, FIG. 1 illustrates a metered-dose, inverted-use valve, generally indicated by the reference numeral 10, which includes a capsule or housing 12 attached by crimping or other suitable means to the mouth 13 of a standard aerosol-type container 14. Frictionally fitted over housing 12, and axially movable relative thereto, is a funnel-shaped cap 16 having an opening 18 formed in its distal end for accurate placement of drops (not shown) from valve 10.

Internally of valve 10, there is a generally hollow cylindrical inner body 24 having inlet slits, as at 26 (only one shown), defined in the upper end thereof and a metering chamber 28 at the lower end thereof. Metering chamber 28 is partially defined by a cylindrical wall 29. (It will be understood that, since valve 10 is to dispense drops, it will be used in the inverted position from that of conventional aerosol packages.) Disposed within inner body 24 for axial movement therein is a valve stem assembly comprising an upper stem portion 30 and a lower stem portion 32 joined by a mid-stem portion 34, comprising a unitary structure. A spring 36 compressed between the upper end 38 of inner housing 24 and a shoulder 40 formed on upper stem 30 biases the valve stem assembly downward, or to the closed position of valve 10, which is the position shown on FIG. 1. A vertical channel 42 disposed centrally of lower stem portion 32 extends between an open end 44 at the lower extreme of the lower stem portion and a horizontal orifice 46 joining the other end of the channel with the surroundings of the lower stem portion. In the closed position of valve 10 shown on FIG. 1, orifice 46 is outside of housing 12 and merely connects channel 42 with the inside of cap 16.

The contents of aerosol container 14 are sealed against escape therefrom by means of lip 50 of mouth 13 of container 14 bearing against a sealing gasket 54 which bears against an outer shoulder 56 formed in housing 12. A stem gasket 58, captured between wall 29 of metering chamber 28 and an inner shoulder 60 formed in housing 12, seals around lower stem portion 32. Sealing is further effected by a shoulder 62 formed on lower stem portion 32 bearing against sealing gasket 58, which contact also limits the downward biasing of the valve stem assembly. A second stem gasket 64 is captured between wall 29 of metering chamber 28 and a shoulder 66 formed in housing 24; although, the second stem gasket has no function when valve 10 is in the closed position shown on FIG. 1. An annular collar 52 supports housing 12 against radial movement.

The closed position of valve 10 shown on FIG. 1 is also the position in which metering chamber 28 is filled with a measured dose. This is accomplished by the material in aerosol container 14 (material not shown) flowing through slits 26 in housing 24, through the housing and past upper stem portion 30, past mid-stem portion 34 through an opening 74 defined in stem gasket 64, and into and filling metering chamber 28 with water solution (not shown) with propellant dissolved therein. Valve 10 may now be operated to dispense the dose in metering chamber 28.

Figure 2:
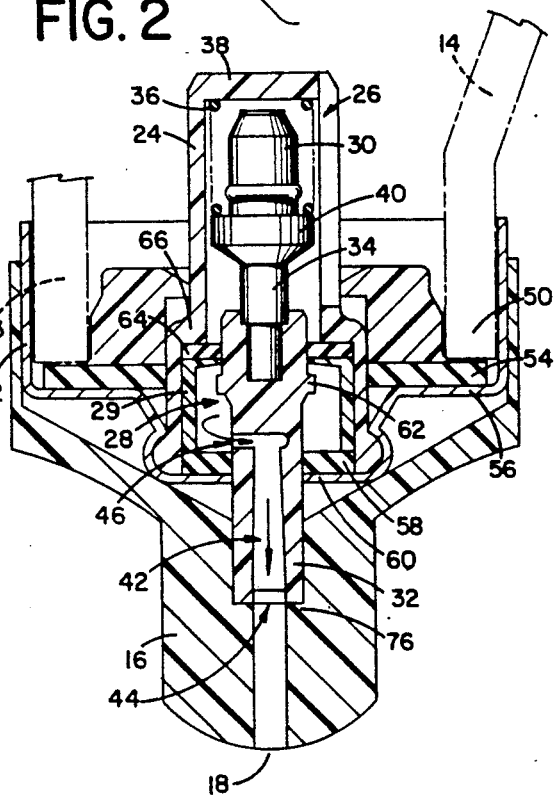
FIG. 2 is an enlarged cross-sectional side elevation view of the valve of FIG. 1 in open position.

FIG. 2 illustrates valve 10 which has been moved to its open or dispensing position. Here, cap 16 has been manually forced upward relative to housing 12, with internal ledge 76 of cap 16 pushing against lower stem portion 32, thus moving the valve stem assembly to the position shown on FIG. 2. It can be seen that, in the open position shown on FIG. 2, lower stem portion 32 has advanced into opening 74 in stem gasket 64, sealing metering chamber 28 from the remaining contents of aerosol container 14. The change in position of lower stem portion 32 has also moved the outer end of orifice 46 into metering chamber 28 so that there is communication between the metering chamber and channel 42 in the lower stem portion. Now, the pressure of the propellant dissolved in the material in metering chamber 28 forces the material, by means of the propellant vaporizing, through orifice 46, through channel 42 and end 44, exiting cap 16 through opening 18. The upward movement of the valve stem assembly terminates when shoulder 62 of lower stem portion 32 engages stem gasket 64.

Figure 3:
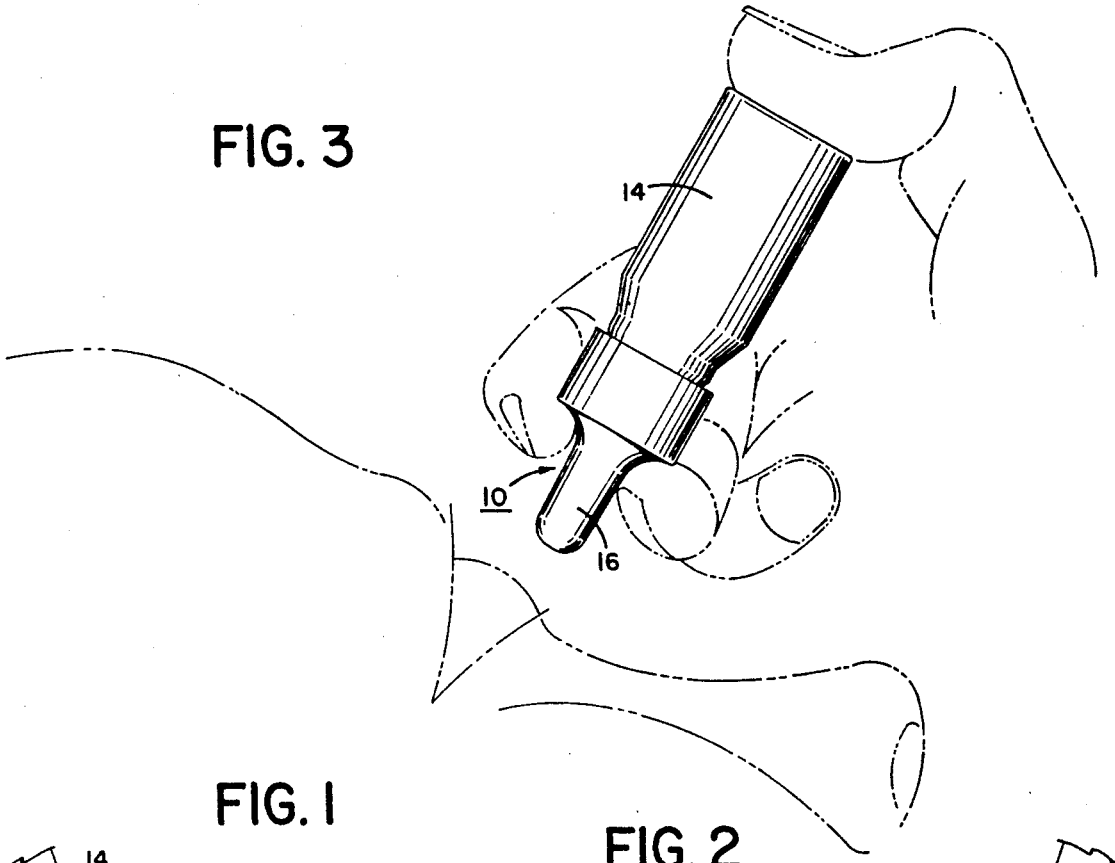
FIG. 3 is a perspective view of an aerosol package according to the present invention being used to administer an ophthalmic medicament.

FIG. 3 illustrates the use of valve 10 attached to aerosol container 14 to dispense a drop of medicament into the eye of a user.

Valve 10 is accurate in dosage and only dispenses the amount of material in the metering chamber. No further material will be available until the user reactivates the valve by moving cap 16 as described above with reference to FIG. 2. The packages are hermetically sealed and may be sterilized by post radiation exposure after packaging, using conventional methods.

Materials of construction of valve 10 may be any suitable ones known in the art. Cap 16 may have any desired configuration depending on the application. Container 14 will likely be a pressure-resistant vessel of glass or metal and may be coated with a suitable material to protect the contents.

Such metering valves can accurately deliver dosages on the order of from less than 10 microliters to over 100 microliters in volume and, when employing a water-soluble propellant according to the present invention, can be especially useful in direct eye application where they may be used for glaucoma or other disease medicaments and solutions for the relief of "dry eye" and redness. The propellant disperses before it can irritate the eye. The invention is also useful for dispensing sterile cleaning solutions for contact lenses.

The following table lists some preferred propellants and their pertinent physical properties:

| Propellant | Vapor Pressure PSI at 70 degrees F. | Water Solubility, Weight percent at 70 degrees F. |
|---|---|---|
| Dimethyl ether | 60 | 34 |
| Difluoroethane* | 60 | 2.6 |
| Diflouromono-chloromethane** | 120 | 3.0 |

*"Propellant 152A."
**"Propellant 22."

For most applications, dimethyl ether is the preferred propellant, since foams created with the other two propellants tend to be somewhat slow to collapse. Dimethyl ether typically foams only slightly, if at all and collapses immediately. Dimethyl ether is also the preferable propellant because of its broad range of water solubility, plus it minimizes the stability of any foam created which quickly breaks to a clear drop of the appearance of the original solution. When dimethyl ether is employed as the propellant, its concentration range may be on the order of about 5–20 weight percent, and preferably 8–14 weight percent. At less than 5 weight percent, dimethyl ether is so soluble that it doesn't generate any significant pressure.

Other propellant substances may be employed as well and such is within the intent of the present invention, provided that the selected substance is safe for the intended application, has sufficient water solubility, and has sufficient vapor pressure at the temperature of intended application. Also, the selected substance must be one that does not create a stable foam with the water solution used. The concentration of whatever propellant is selected is critical to obtain the necessary solubility as well as to emit drops in the desired form, i.e., not splattering on hitting a surface or too slow for satisfactory consumer use. Velocity of drops from the valve increases, as well as increased possibility of splattering, if the concentration of propellant becomes excessive, i.e., over about 20 weight percent in the case of dimethyl ether propellant. Viscosities on the order of 1 centipoise or less may also tend to cause excessive foaming and high levels of surfactants in the ingredients may lead to excessive foaming and slow collapse of the foam.

As noted above, high levels of surfactants may be undesirable, but, in some cases, some surfactant may be desirable, since it can help the drops separate from the tip of the applicator. High surfactant concentrations may be counterbalanced by the addition of materials such as alcohol or silicone compounds.

Substances dispensed may have viscosities in the range of on the order of about 1–3000 centipoises. Volumes of drops may range from 10 microliters or less up to any practical desired maximum.

The use of a propellant such as difluoroethane, which has relatively limited water solubility compared to dimethyl ether, permits a variation of the invention. In this case, a concentration of propellant in excess of its water solubility limit is used and then, when the package is inverted, the excess propellant will float on top of the water solution in the package. This layer of excess propellant maintains a reservoir of propellant to assure sufficient pressure for dispensing the water solution as the container becomes empty. When a propellant is used in fully water-soluble concentrations, no excess is present and some of the propellant evaporates from the water solution to fill unoccupied space as the container becomes empty. In this embodiment, the total concentration of difluoroethane may be on the order of about 4 weight percent.

EXAMPLES

I. A water-based material comprising:

(a) 90 weight percent water suspension of "R.S. Betaxolol," an ophthalmic preparation furnished by Alcon Laboratories, Fort Worth, Tex.; and (b) 10 weight percent dimethyl ether was prepared at 70 degrees Fahrenheit in a 22 cubic centimeter Wheaton S 204xx clear coated aerosol bottle with a Valois DF 30/25 microliter metering valve with Valois CB-13 actuator. The solution included small quantities of a preservative and a surfactant to help spread the solution across the eye. Individual drops were dispensed in the form of a large froth bubble which broke quickly to a clear drop. Average dose was 15 micrograms.

II. A water-based material comprising:

(a) 90 weight percent Opti-Clean Concentrate, a preparation for cleaning contact lenses, furnished by Alcon Laboratories; and (b) 10 weight percent dimethyl ether was prepared at 70 degrees Fahrenheit in an aerosol package identical to the above. The material included a small quantity of a surfactant to help spread the drop across the lens. Individual drops were dispensed in the form of an unstable foam which immediately broke to a clear drop. Average dose was 25 micrograms.

III. A water-based material comprising:

(a) 90 weight percent Tears Naturelle, a preparation for the relief of "dry eye," furnished by Alcon Laboratories; and (b) 10 weight percent dimethyl ether was prepared at 70 degrees Fahrenheit in an aerosol package identical to the above. The material included a small quantity of a surfactant to help spread the drop on the eye. Individual drops were dispensed which had foam breaking characteristics in between those of Examples I and II.

IV. A water solution, comprising:

(a) 90 weight percent deionized water; and (b) 10 weight percent dimethyl ether was prepared at 70 degrees Fahrenheit in an aerosol package identical to the above. Individual drops were dispensed which had no foam and only a slight amount of bubbling as the propellant dispersed.

It will thus be understood that the objects set forth above, among those made apparent from the preceding description are efficiently attained. It will be understood that the above specific examples are intended to be illustrative only and that the invention is not limited to the specific conditions, materials, or concentrations given therein but encompasses the full range of effective conditions and concentrations which may be used in practicing the invention.

It is also to be understood that the following claims are intended to cover all of the generic and specific features of the invention herein described and all statements of the scope of the invention which, as a matter of language, might be said to fall therebetween.

I claim:

1. A system for dispensing a single drop of water solution, comprising:

(a) a container for said water solution;

(b) single-dose metering means disposed for operative communication with said water solution in said container, said metering means including:

(i) an outlet in communication with a dispensing tip;

(ii) an inlet in communication with a water solution in said container;

(iii) a chamber defined between said inlet and said outlet; and (iv) actuating means disposed in said chamber and operable to selectively close either of said inlet or said outlet; such that when said outlet is closed and said inlet is opened, said chamber can be filled with a discrete quantity of said water solution and, subsequently, when said outlet is opened and said inlet is closed, said discrete quantity of water solution can be expelled from said dispensing tip; and (c) a propellant dissolved in said water solution in sufficient concentration so as to expel said single drop from said chamber and said dispensing tip when said actuating means is actuated.

2. A system, as defined in claim 1, wherein said propellant is selected from the group consisting of dimethyl ether, difluoroethane, and difluoromonochloromethane.

3. A system, as defined in claim 1, wherein said propellant is dimethyl ether in a concentration of from about 5 to about 20 weight percent.

4. A system, as defined in claim 1, wherein said propellant is dimethyl ether in a concentration of from about 8 to about 14 weight percent.

5. A system, as defined in claim 1, wherein said propellant is present in a concentration in excess of its water solubility.

6. A system, as defined in claim 5, wherein said propellant is selected from the group consisting of difluoroethane and difluoromonochloromethane.

7. A system, as defined in claim 1, wherein said water solution is an ophthalmic medicament.

8. A method of applying a single drop of water solution, comprising:

(a) providing single-dose metering means, said metering means including:

(i) an outlet in communication with a dispensing tip;

(ii) an inlet in communication with said water solution;

(iii) a chamber defined between said inlet and said outlet; and (iv) actuating means disposed in said chamber and operable to selectively close either of said inlet or said outlet; such that when said outlet is closed and said inlet is opened, said chamber can be filled with a discrete quantity of said water solution and, subsequently, when said outlet is opened and said inlet is closed, said discrete quantity of water solution can be expelled from said dispensing tip;

(b) dissolving a propellant in said water solution;

(c) operating said metering means so as to expel from said chamber and said dispensing tip said discrete quantity of water solution in the form of a single drop; and (d) allowing said propellant to disperse from said drop.

9. A method, as defined in claim 8, further comprising the step of providing the propellant from the group consisting of dimethyl ether, difluoroethane, and difluoromonochloromethane.

10. A method, as defined in claim 8, further comprising the step of providing as said propellant dimethyl ether in a concentration of from about 5 to about 20 weight percent.

11. A method, as defined in claim 8, further comprising the step of providing as said propellant dimethyl ether in a concentration of from about 8 to about 14 weight percent.

12. A method, as defined in claim 8, further comprising the step of providing said propellant in a concentration in excess of its water solubility.

13. A method, as defined in claim 12, further comprising the step of providing said propellant from the group consisting of difluoroethane and difluoromonochloromethane.

14. A method, as defined in claim 8, further comprising the step of providing said water solution as an ophthalmic medicament.

* * * * *